United States Patent [19]

Monson et al.

[11] 3,954,634

[45] May 4, 1976

[54] STABLE, LOW-VISCOSITY FABRIC SOFTENER

[75] Inventors: James A. Monson; Wendy L. Stewart, both of Racine; Harold F. Gruhn, Sturtevant, all of Wis.

[73] Assignee: S. C. Johnson & Son, Inc., Racine, Wis.

[22] Filed: July 12, 1974

[21] Appl. No.: 488,120

Related U.S. Application Data

[63] Continuation-in-part of Ser. No. 383,215, July 27, 1973, abandoned.

[52] U.S. Cl. ..... 252/8.8; 252/8.75

[51] Int. Cl.[2] ..... D06M 13/46

[58] Field of Search ..... 252/8.75, 8.8; 117/139.5 C, 139.5 Q

[56] References Cited

UNITED STATES PATENTS

| | | | |
|---|---|---|---|
| 3,033,704 | 5/1962 | Sherrill et al. | 117/47 |
| 3,583,912 | 6/1971 | Clark | 252/8.8 |
| 3,681,241 | 8/1972 | Rudy | 252/8.75 |

*Primary Examiner*—Herbert B. Guynn

[57] ABSTRACT

Aqueous, stable, highly concentrated fabric softening dispersions of low viscosity and transparency are formed from cationic softening agents containing 1 or 2 quarternized nitrogen atoms and being derived in part from a fatty acid having at least 12 carbon atoms and, containing optionally, lower aliphatic alcohol, optical brighteners, dyes and fragrances. Deionized water and the fabric softener are pre-mixed and homogenized at pressures at 500 to 8,000 p.s.i. to produce a highly concentrated, stable, fabric softening dispersion.

7 Claims, No Drawings

STABLE, LOW-VISCOSITY FABRIC SOFTENER

This application is a continuation-in-part of application Ser. No. 383,215, filed July 27, 1973, now abandoned.

BACKGROUND OF THE INVENTION

This invention relates to the art of fabric softening, and more particularly, it relates to a substantially translucent, highly concentrated, stable fabric softening composition useful in the wash or rinse cycle of an automatic washing machine and a process for forming said formulation.

The art of fabric softening is an old one and generally most of the fabric softeners which have been heretofore formulated and marketed required addition to the rinse cycle of a washing machine. By and large, these formulations were aqueous dispersions containing active ingredients in concentrations from 4 to 7%. In recent years formulations have been developed which allowed the consumer to add the softening formulation before the wash cycle along with the detergent and bleach. However, many problems were experienced with such softening formulations.

Because the ideal pre-wash cycle fabric softener would have to be in sufficient quantity to remain active through the wash cycle in order to be effective during the rinse cycle, two types of approaches were taken to achieve this end. Initially, compositions having a relatively low concentration of active ingredients were added in large amounts at the beginning of the wash cycle. This procedure presented many problems. It was necessary for the consumer to employ on the order of at least twice the normal amount of formulation required. This procedure would also require that the consumer maintain large quantities of fabric softening formulations on his shelves and would involve wasteful use of fabric softeners. Therefore, consumers were reluctant to employ such fabric softening formulations.

To overcome this difficulty, it has been proposed to prepare a high potency fabric softening formulation which, when employed in conventional quantities, would provide effective fabric softening in the presence of detergents in the wash cycle of laundry machines. For this purpose fabric softening formulations containing in the order of 10 to 12% active ingredients were proposed. However, it has not been feasible heretofore to prepare emulsions of a high concentration employing the commercially accepted fabric softeners available. The generally effective fabric softeners which have found wide spread commercial acceptance, such as the di-(higher alkyl)-di-(lower alkyl) ammonium salts, could not be readily processed into stable, highly concentrated emulsions. Using typically commercially available fabric softening agents, formulations containing a maximum of 7 to 8% actives can be prepared without incurring stability difficulties.

Previous attempts to prepare more highly concentrated fabric softening formulations have been subject to numerous defects and deficiencies. For example, in U.S. Pat. No. 3,681,241 it has been proposed to employ a fabric softening composition which includes a quaternary ammonium compound, at least one amido imidazolinium alkyl sulfate and an ionizable salt in amounts between 0.005% and 0.1% for viscosity control. It has further been proposed that the subject softening emulsion have a viscosity in the order of 200 to 500 centipoises for optimum consumer acceptance. It has also been proposed that the composition be homogenized at pressures up to about 2500 lbs. per square inch. Various defects have been noted with such proposed highly concentrated emulsions. Initially, it has been found that unless supplementary emulsions stabilizers, such as conventional surfactants are employed, then within three to four days after preparation, the emulsions tend to stratify and unduly increase in viscosity beyond an amount acceptable to the consumer.

Such concentrated softening compositions as disclosed in the U.S. Pat. No. 3,681,241 patent are opaque, not transluscent. It has long been recognized that consumer acceptability is highly enhanced if a translucent composition is formulated for commercial use. Consumers can establish the purity of the softening composition by changes in the opacity of a composition should the composition be marketed in a translucent state. This is not possible with the opaque compositions.

Further, in the proposed preparations which are allegedly storage stable it is necessary to employ not only a mixture of quaternary fabric softening agents, but also non-ionic stabilizers and electrolytes for viscosity control. This need has unduly increased the cost of manufacturing the product and has required more extensive mixing equipment and inventories of raw materials. The prior art proposed concentrated softeners have initial viscosities in excess of 200 centipoises. However, it has long been recognized that homemakers prefer to employ liquid laundry compositions which are easy to pour and are readily exhausted from the container. Accordingly, it has long been considered desirable to provide liquified laundry aids in forms having viscosity less than at least 150 centipoises and preferably less than 100 centipoises. Further, laundry product manufacturers have long desired a low cost and highly concentrated fabric softener which, owing to its low viscosity and other factors, is readily diluted during the wash cycle and exhibits excellent exhaustion properties onto synthetic and natural fibers.

Accordingly, there exists a long felt need, which up to now has been unsatisfied, to provide a highly concentrated, storage stable substantially translucent fabric softening formulation having a low viscosity and effective softening and exhaustion properties.

It is, therefore, a primary object of the invention to provide a highly concentrated fabric softening composition having from about 7 to 15% and particularly 10 to 14% active fabric softening ingredients having extended storage stability.

It is another object of the invention to provide a storage-stable concentrated fabric softening composition exhibiting low viscosity for enhanced pouring capabilities.

It is an additional object to provide a stable, highly concentrated fabric softener having a single active ingredient to reduce manufacturing and consumer costs.

It is yet another object to provide a substantially translucent, highly concentrated, storage-stable fabric softening formulation.

Other objects and advantages will be apparent to those skilled in the view of the following detailed description of the invention.

SUMMARY OF THE INVENTION

The above and other objects are met in a fabric softening composition including from about 7 to 15% by weight of a cationic fabric softening agent containing 1 to 2 quarternized nitrogen atoms and being derived in part from a fatty acid having at least 12 carbon atoms; up to about 10% by weight of a lower aliphatic alcohol; and wherein the balance of the composition is an aqueous vehicle substantialy free of electrolytes and consisting essentially of water; wherein the initial viscosity of the compositions is up to about 150 centipoises; and having a viscosity coefficient of from 0.8 to 5.

As utilized in the instant specification and claims, the viscosity coefficient $C_v$ is defined as $C_v = v_x/v_i$ wherein $v_x$ is the viscosity after 2 months and $v_i$ is the initial viscosity. For the purposes of the present invention, the $v_x$ is only determined if the dispersion is otherwise stable, i.e., no stratification or agglomeration.

Typical cationic fabric softening agents include quaternary ammonium compounds of the formula

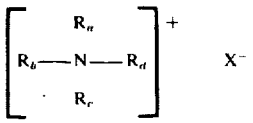

wherein $R_a$ and $R_b$ are each alkyl groups having from 12 to 22 carbon atoms; $R_c$ and $R_d$ are alkyl groups having from 1 to 6 carbon atoms; $X^-$ is an anion imparting water dispersibility to said fabric softener; the quaternized product of dialkylene triamine, each alkylene group having 1 to 3 carbon atoms and a fatty acid having 12 to 22 carbon atoms; and mixtures thereof. Enhanced results are obtained and, accordingly, it is preferred to employ the alkyl sulfate quaternized reaction product of diethylene triamine and hardened, partially hardened or unhardened tallow fatty acids as the softening agent; and it is most preferred to use the above reaction product derived from tallow fatty acids having degree of unsaturation of 40 to 50%.

Such highly concentrated, stable fabric softening compositions are prepared by pre-mixing from 7 to 15 parts by weight of a cationic fabric softening agent as described above and up to about 10 parts by weight of a lower aliphatic alcohol with from 92 to 74.5 parts by weight of the above aqueous vehicle at a temperature ranging from room temperature to a temperature above the softening point of the fabric softener, depending on the softener used, with sufficient agitation to provide a creamy gel-like emulsion free of entrapped air; then mixing the creamy emulsion at high shear pressures from about 500 to 8,000 p.s.i. at a temperature above the softening point of the fabric softener to provide a thin substantially translucent, stable, highly concentrated dispersion having a particle size from about 0.0005 to 5 microns; thereafter immediately cooling the stable emulsion to prevent agglomeration of said particles and to ensure a stable emulsion having a viscosity less than about 150 centipoises. Typically high shear pressures are generated by homogenizing at pressures in the order of about 2,000 to 6,000 p.s.i. Pre-mixing and mixing temperatures from about 65° to 180°F. are preferably employed in the process.

DESCRIPTION OF PREFERRED EMBODIMENTS

The cationic softening agents useful in this invention are those containing one or two quaternized nitrogen atoms and derived, in part, from a fatty acid having at least 12 carbon atoms. Among the useful cationic softening agents are (a) the reaction products of dialkylene triamines, the alkylene groups having 2 or 3 carbon atoms and a saturated, partially saturated or unsaturated fatty acid quaternized with dimethyl sulfate, methyl halide, i.e., chlorides, bromides, iodides, ethyl halide, and various other conventional quaternizing agents, and (b) the dialkyl di(lower alkyl) quaternary ammonium chlorides.

Specific commercially available cationic softening agent falling in category (a) include those sold under the trademark Varisoft 475 from Varney Chemical Division of Ashland Chemical and Ammonyx 4080 from Onyx Chemical Company. Specific commercially available cationic softening agents falling in category (b) include those sold under the trademarks Arquad 2HT from Armak Company and Adogen 432 and 442 from Ashland Chemical Company.

The cationic softening agents falling in category (a) are sometimes referred to as imidazolinium compounds having the formula:

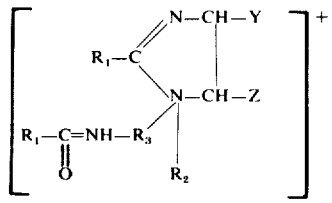

(Formula I)

wherein $R_1$ is hydrogen, an alkyl group having 1–22 carbon atoms, or a cycloalkyl group having 1–22 carbon atoms (such as methyl, ethyl, propyl, butyl hexyl, decyl, lauryl, myristyl, palmityl, stearyl, tetracosanyl, cyclopentyl, cyclohexyl, oleyl, linoleyl); $R_2$ is an alkyl group having 1–6 carbon atoms; $R_3$ is a divalent alkylene group having 1–3 carbon atoms and A is an anion selected from sulfates, lower ($C_1$-4) alkyl sulfates, nitrates, nitrites, phosphates, carbonates, and halides (such as chloro, bromo, fluoro and iodo).

Although the above imidazolinium formula is often used to describe the quaternized reaction product of a fatty acid and dialkylene triamine, it has been recently discovered that this formula may not truely represent the structure of this product. It is thought that the true structure is a resonant structure which may be represented by the formula:

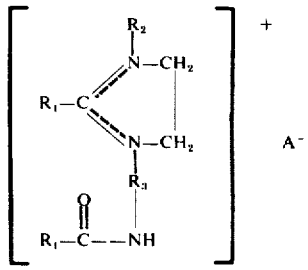

which allows the positive charge to be shared by both Nitrogen atoms. Therefore, whenever the term "imidazolinium" is used it means the quaternized reaction product of 2 moles of fatty acid with 1 mole of dialkylene triamine and not Formula I.

Examples of useful cationic softening agents are disclosed in U.S. Pat. No. 2,874,074 and 2,995,520; British Pat. No. 985,321; and McCutcheon's *Detergents and Emulsifiers* 1970 *Annual*.

An expecially preferred cationic softening agent is the dimethyl sulfate quaternized reaction product of stearic acid and diethylene triamine.

Particularly preferred dialkyl (di lower alkyl) ammonium quaternary fabric softening agents employed in the invention include compounds wherein the alkyl groups have from 16 to 20 carbon atoms and the lower alkyl groups have from 1 to 3 carbon atoms. Particularly preferred imidazolinium type fabric softening agents employed herein include the quaternized reaction product of hardened, unhardened or partially hardened tallow fatty acids having a degree of unsaturation of from 40 to 50% or the residue from $C_{14}$–$C_{18}$ fatty acids and diethylene triamine.

Preferred anions imparting water dispersibility to the cationic fabric softeners include alkyl sulfates and particularly ethyl and methyl sulfates (also designated ethosulfate and methosulfate).

Typical quaternary ammonium compounds employed in the invention include distearyl dimethyl ammonium chloride, ditallow dimethyl ammonium bromide, distearyl di(isopropyl) ammonium methosulfate, the imidazolinium type compounds derived from tallow fatty acid quaternized with diethyl sulfate derived from hydrogenated oleic acid quaternized with ethyl sulfate derived from mixed saturated $C_{16}$–$C_{18}$ fatty acids quaternized with methyl sulfate derived from mixed saturated and unsaturated $C_{16}$–$C_{18}$ fatty acid quaternized with dimethyl sulfate, and derived from partially hardened tallow fatty acids having a degree of unsaturation from 40 to 50% quaternized with diethyl sulfate.

In addition to the foregoing ingredients which have been discussed in detail, it will be apparent to those skilled in the art that a variety of other ingredients may be employed, which do not affect the essential nature of the fabric softening formulation. Indeed, many such ingredients may be provided for the purpose of improving other properties thereof or for the purpose of improving consumer acceptance. Typical ingredients include, but are not limited to, optical brighteners, color, perfumes and the like each in an amount ranging up to 2.0% by weight.

It has been found that the presence of electrolytes in the fabric softening compositions, although controlling viscosity, substantially reduces the storage stability of the present fabric softening compositions. In particular the presence of electrolytes in the composition tends to degrade the stability of the homogenized fabric softening composition in as little as two to four days. Degradation can take the form of stratification, formation of agglomerates and undue increases in viscosity of the fabric softening composition. Accordingly, it is necessary that the aqueous fabric softening compositions are formed from the aqueous vehicles substantially free from electrolytes and consisting essentially of water. In particular, deionized water is a preferred aqueous vehicle. Other conventional solvents compatible with these ingredients and compatible with bleaches and detergents may be employed.

In general, the cationic fabric softening agents of the invention may be employed in amounts of about 8% to 15% by weight of the total fabric softening composition. Commercially, it is desired to employ as high a concentration as is practicable. Therefore, compositions containing from about 10% to 14% by weight of fabric softening agent are particularly preferred. Many of the commercially available cationic fabric softening agents contain substantial amounts of alcohol. It is a significant advantage of the present invention that such commercial preparations may be employed without further treatment to remove alcohol, as has been necessary in prior art compositions. In particular in U.S. Pat. No. 3,681,241 it is stated that the amount of lower aliphatic alcohol should not exceed about 1%. It is admittedly stated that it is not practical to prepare alcohol-free emulsions as would be desired by the prior art. It has now been discovered that commercial cationic fabric softeners containing even up to 25% alcohol and higher can be employed without further treatment in the present fabric softening compositions. For the purposes of the invention it is usually preferred to employ from 0 to 10% and particularly from 1% to 5% by weight of the total composition of a lower aliphatic alcohol such as methanol, ethanol, propanol, isopropanol, butanol, isobutanol, t-butanol, etc., with isopropanol being preferred. The weight ratio of alcohol to softener may be from 1:1 to 1:10.

Accordingly, preferred fabric softening compositions include stable dispersions having an initial viscosity less than 150 centipoises include the following ingredients present in the below weight percentages based on the total weight of the composition.

| Ingredient | Weight Percent |
|---|---|
| 1. Aqueous Vehicle<br>i.e., deionized water | 74.5% – 92% |
| 2. Cationic Fabric Softening Agent<br>i.e., fatty amido imidazolinium methosulfate derived from unhardened tallow fatty acid of $C_{14}$ – $C_{18}$ chain length | 8 – 15% |
| Miscellaneous Additives<br>i.e., isopropyl alcohol, optical brightener, dye, fragrance | 0 – 10.5% |

As noted above, the fabric softening dispersions of the present invention have a low initial viscosity over an extended time period without becoming otherwise unstable. The fabric softening dispersions are characterized particularly by having an initial viscosity of less than 150 centipoises, preferably less than 100 centipoises and most preferably less than 55 centipoises, and a viscosity coefficient $C_v$ within the range of from 0.8 to 5, preferably within the range of from 0.8 to 3.5 and most preferably within the range of from 1.0 to 2.5. It is within these viscosities that the fabric softening dispersion of the present invention exhibits its excellent stability characteristics as shown by the viscosity coefficients which are a direct measure of stability.

A key feature of the present invention is the manner in which the ingredients are combined to form the present translucent, stable, concentrated fabric softening composition of low viscosity. In general, a cationic fabric softening agent containing 1 or 2 quaternarized nitrogen atoms and being derived in part from a fatty acid having at least 12 carbon atoms is slowly added to an aqueous vehicle free of electrolytes and consisting essentially of water. The cationic softening agent is preferably added at a slow rate to the aqueous vehicle, for example, deionized water, with agitation. Care should be taken that agitation does not cause formation of air bubbles which can become entrapped in the emulsion, thereby seriously affecting the stability thereof. This pre-mixing step may be carried out employing suitable conventional mechanical stirrers. The premixing step is carried out in a vessel wherein the temperature is maintained at from room temperature to a temperature above the softening point of the fabric softening agent. Preferably the pre-mixing is conducted at a temperature above the softening point of the cationic material and most preferably the initial aqueous vehicle temperature is above the softening point of the material and equal to the pre-mixing temperature.

For most purposes it is sufficient that the temperature of the mix is controlled between about 65° to 180°F. Also, if ambient or room temperature mixing is to be used, for some cationic materials, including the imidazolinium softeners, it may be desirable to heat the softeners to improve flow characteristics and immediately cool the same just prior to pre-mixing.

The purpose of pre-mixing is to begin the process of particle size reduction. Although the starting cationic materials are less viscous than the materials which have been pre-mixed in accordance with the process of the present invention, this pre-mixing is essential in order to produce a low viscosity, stable dispersion. The agitation times and rates may vary widely depending on the type of starting material, the size of the mixing vessel, the type of impeller, etc. A further parameter is the increase in viscosity caused by the pre-mixing process itself necessitating a corresponding increase in agitation rate during the pre-mixing step. Because of the great number of parameters affecting the pre-mixing process, it is difficult to specify exact process limitations. However, the agitation is continued under such conditions so as to produce a creamy, gel-like emulsion without the inclusion of air. Satisfactory results have been obtained with an initial agitation rate of 300 to 1000 RPM with the rate increasing as viscosity increases up to a maximum of from 1500–2000 RPM. Furthermore, within these agitation rates, a mixing time within the range of from 0.5 to 30 minutes produces the proper emulsion.

The second step in the process for producing a stable, pourable fabric softening dispersion of the invention includes mixing the creamy gel-like emulsion produced by the pre-mixing step at high shear pressures from about 500 to 8000 p.s.i. Such shear pressures are preferably generated through homogenization and preferably at pressures of from 500 to 6000 p.s.i. Suitable homogenizers which may be employed in the present process are disclosed on pages 310–314 of EMULSIONS; THEORY AND PRACTICE, by Paul Becher, published by Reinhold Publishing Corporation, in 1957. Enhanced results are obtained and accordingly, on the small scale, it is preferred to employ the well-known MANTON GAULIN homogenizers employing single stage and double stage valves; while on a larger scale CHERRY-BURREL homogenizers are suitable, although any conventional homogenizer capable of producing shear pressures within the above range may be used.

Employing the preferred cationic fabric softening agents, homogenization pressures are usually from about 2000 to 5000 p.s.i., provided that the temperature of the gel during homogenization is adjusted to above the softening point of the fabric softening agent, and the temperature of the aqueous vehicle and quaternary before and during pre-mixing is above the softening point of the quaternary.

It has been found that as the percentage of active materials is decreased to about 7% the lower limit of homogenization pressure can be reduced to 500 p.s.i. with no adverse effects on stability or viscosity. This lower pressure can be utilized when the active ingredient has been melted prior to pre-mixing and the water temperature during mixing is maintained above the softening point of the active ingredient.

After homogenization, a thin, substantially translucent, stable dispersion is recovered wherein the dispersed fabric softening agent has a particle size from about 0.0005 to about 5 microns. In order to prevent agglomeration of the dispersed fabric softening particles and to insure the integrity of the stable aqueous dispersion formed, it is preferred to immediately cool the honogenized dispersion to a temperature below about 80°F. Conventional cooling techniques may be employed in this step and particularly force cooling techniques which provide an immediate cooling to a pre-determined temperature are preferred.

It is a unique feature of the invention that the homogenization step at ultra high shear pressures provides a stable aqueous dispersion of fabric softening agent having a low particle size. As disclosed in EMULSION SCIENCE by Phillip Sherman, copyright 1968 by Academic Press, concentrated emulsions and dispersions are usually very viscous. High concentration an high stability are often conflicting requirements. It has also been disclosed that when crude emulsions are homogenized a rise in viscosity is observed. This is usually due to a reduction in particle size, resulting in increased interfacial area and mutual interaction between the globules. Accordingly, it is particularly surprising that the present fabric softening dispersions formed at high pressure homogenization exhibit low viscosity, high stability and low particle size.

In U.S. Pat. No. 3,681,241 homogenization pressures below about 2500 p.s.i. resulted in emulsions having viscosities no less than 175 centipoises. Further, it was found that emulsion stabilizers were necessary to provide a stable emulsion and electrolytes were necessary for viscosity control. It is a substantial advantage of the present dispersion that no emulsion stabilizers nor electrolytes are needed to stabilize a fabric softening composition containing the aforementioned cationic fabric softening agents, particularly the aforesaid imidazolinium type salts. It has been established that the presence of electrolytes tends to destabilize the dispersion upon storage while initially providing a lower viscosity. Further, the present dispersions may exhibit viscosities substantially below about 100 centipoises even at homogenization pressures of 1000 p.s.i.

Miscellaneous additives such as optical brighteners, dyes and fragrances may be added to the present dispersions during the pre-mixing step or after homogenization. If added after homogenization, it is generally preferred to blend the additives with the dispersion from 0.5 to 20 minutes. The fabric softening dispersions prepared by the present process are generally translucent having a slight haze.

In addition the surprising viscosity and stability characteristics of the fabric softening dispersions of the present invention, it has also been found that these dispersions have superior exhaust characteristics when compared with prior art softeners. Generally, the composition of the present invention will deposit up to 50% more active ingredient onto the fabrics than conventional compositions having a similar percentage of active ingredients. The initial deposition rate of the composition of the present invention is from 0.40–0.50 gms. of active ingredient per first minute when diluted to a concentration of 0.42–0.84 g./gal.

The following examples serve to illustrate certain preferred embodiments of the present composition and process and are not limitative in scope.

EXAMPLE I

In order to illustrate preparation of a storaage stable, substantially translucent, highly concentrated fabric softening dispersion having low viscosity, the following fabric softening preparation was prepared. The weight percents are based on the total weight of the composition.

| Ingredient | Proportion by Weight |
|---|---|
| Deionized water | 81.20 |
| Varisoft 475[1] | 18.00 |
| Triazinyl diamino stilbene di sodium sulfonate (optical brightener) | 0.20 |
| Dye intermediate (0.2% AI) | 0.30 |
| Fragrance | 0.30 |

[1]Varisoft 475 (Ashland Chemical) 3 parts reaction product of 2 moles mixed saturated $C_{16}$–$C_{18}$ fatty acids and 1 mole of diethylene triamine quaternized with dimethyl sulfate and 1 part isopropanol.

The imidazolinium salt was blended at room temperature, i.e., 75°F. with the optical brightener. The imidazolinium salt (Varisoft 475)-optical brightener blend was slowly added to the deionized water which had been placed in a 3300 ml. stainless steel mixing vessel having a 155 mm. diameter and provided with a mixed flow regular pitch impeller 1⅞ inches in diameter as shown in U.S. Pat. No. 2,787,448 with agitation at 500 RPM. As the viscosity of the blend increased, the speed of agitation was correspondingly increased to 1800 RPM but at a velocity sufficient to prevent entrapment of air in the blend. Baffles are employed to improve mixing and agitation of the blend was continued for ten minutes at 1800 RPM until a creamy, homogeneous dispersion was formed. During the pre-mixing, the dye and perfume were added.

The dispersion was immediately homogenized in a Manton-Gaulin homogenizer at 6000 pounds per square inch pressure and at room temperature. i.e., 75°F.

The viscosity of the resulting fabric softening composition was measured as 33 centipoises. The fabric softening composition was evaluated for fabric softening in the presence of a typical commercial detergent and exhibited good fabric softening properties. Similar results are obtained when the quaternary ammonium compounds of the present invention are substituted for the imidazolinium salt employed herein. Further, when other saturated or unsaturated alkylamido imidazolinium alkyl sulfates are substituted for the present salt, similar results are obtained. For example, when the following cationic fabric softening agents are substituted for the above imidazolinium salt, a stable, substantially translucent fabric softening composition of low viscosity is obtained:

Diarachyldyl dimethyl ammonium chloride

Di "tallow" dimethyl ammonium sulfate

Imidazolinium type compound derived from oleic acid hydrogenated to an iodine value of 40–60, diethylene triamine and dimethyl sulfate Imidazolinium type compound derived from saturated $C_{16}$–$C_{18}$ fatty acids, diethylene triamine and diethyl sulfate Imidazolinium type compound derived from mixed $C_{14}$–$C_{16}$ fatty acids, diethylene triamine and diethyl sulfate Tridecyl methyl ammonium chloride Monotetradecyl trimethyl ammonium chloride

EXAMPLE II

In order to demonstrate the preparation of a fabric softening composition of the invention employing different homogenization pressure, the procedure as set forth in Example I was repeated with the same ingredients except 81.30% by weight of deionized water and 0.2% of dye intermediate were employed. The formulation was prepared in accordance with Example I except the components were heated to a temperature between 135° and 140°F. before pre-mixing and the homogenization pressure was 5000 p.s.i. Further, after the addition of the dye and fragrances, the dispersion was agitated for 15 minutes and filtered. The resultant formulation had a viscosity of 22 centipoises and, while slightly hazy, was translucent.

EXAMPLE III

In order to determine the effects of changing the temperature at which the ingredients are blended, the procedure as set forth in Example II was repeated with the exception that the temperature of the blend during agitation and homogenization was controlled at 180°F. The resultant formulation had a low viscosity and was translucent.

EXAMPLE IV

The procedure of Example II was repeated with the exception that 14.4% by weight of the Varisoft 475 and 84.9% by weight of deionized water were employed. The resultant formulation had an initial viscosity of 8 centipoises. After six days the formulation had a viscosity of only 12 centipoises. After nine days there was a decrease in the viscosity to 10 centipoises. This demonstrates the storage stability and low viscosity of the present formulation.

EXAMPLE V

The procedures set forth in Example I were repeated with the exception that the homogenization pressures were varied from 500 p.s.i. to 6000 p.s.i. and the components were pre-mixed and homogenized at 140°F. The following table illustrates the viscosity in centipoises of the resultant formulations:

| Homogenizing Pressure | Viscosity |
|---|---|
| 500 | 1532 |
| 1000 | 294 |
| 2000 | 66 |
| 4000 | 26 |
| 5000 | 20 |
| 6000 | 20 |

The criticality of employing homogenization pressures from 2000 to about 8000 p.s.i. when more than 12% softener is homogenized is demonstrated by the foregoing tests.

The foregoing tests also serve to demonstrate that stable formulations having low viscosity and under 150 centipoises are achieved by the present process.

EXAMPLE VI

In order to demonstrate the long term storage stability of the present fabric softening formulations, the procedure of Example I was repeated except the water was heated to 120°F. and the Varisoft 475 was heated to 140°F. before pre-mixing with homogenization pressures from 500 to 4000 p.s.i. The following table illustrates the initial viscosity of the resulting emulsions and their corresponding viscosities after nine days storage:

| Homogenization Pressure | Initial Viscosity | 9-day Viscosity |
|---|---|---|
| 500 | 730 | 1180 |
| 1000 | 178 | 302 |
| 2000 | 50 | 72 |
| 4000 | 26 | 34 |

EXAMPLE VII

To further illustrate the storage stability of the composition of the present invention, the following composition was formulated:

| Ingredient | Proportion by Weight |
|---|---|
| Deionized water | 79.4 |
| Varisoft 475[1] | 18.0 |
| Distyryl biphenyl derivative (1.2% AI) (optical brightener intermediate) | 2.0 |
| Dye intermediate (0.2% AI) | 0.3 |
| Perfume | 0.3 |

[1]See Example I

The water wash charged into the mixing vessel at room temperature (75°F.). About ⅓ of the imidazolinium softener was added at room temperature with agitation, followed by the dyes and the perfume. The remaining imidazolinium softener was added to room temperature with sufficient agitation to form a creamy gel-like emulsion. This emulsion was then homogenized at varying pressures as shown in Table 1. The initial viscosity was noted as well as the viscosity after two weeks and two months storage at room temperature. Also, the physical appearance of each sample was noted.

Table 1

| Pressure p.s.i. | Viscosity ($C_p$) Initial | 2 Week | 2 Month | Appearance 2 Months |
|---|---|---|---|---|
| 4000 | 54.5 | 126 | 154 | Stable, fine floc |
| 5000 | 40.5 | 88 | 110 | Stable, fine floc |
| 6000 | 32.0 | 70 | 80 | Stable, fine floc |
| 7000 | 30.5 | 60 | 68 | Stable, heavy floc |
| 8000 | 28.5 | 46 | 54 | Stable, fine floc |

In all the above samples, the initial viscosity was quite low and the viscosity coefficient was less tha 3, indicating a very stable system. Also, each sample was quite stable with only some well suspended floculation being noted.

EXAMPLE VIII

Using the procedure of Example VII, a series of softener compositions were homogenized at pressures as shown in Table 2. The viscosities and appearance were noted as in Example VII.

Table 2

| Pressure p.s.i. | Viscosities Initial | 2 Week | 2 Month | Appearance 2 Months |
|---|---|---|---|---|
| 4000 | 73.5 | 120 | 140 | Stable |
| 5000 | 42.0 | 70 | 76 | Stable |
| 6000 | 33.5 | 54 | 60 | Stable |
| 7000 | 24.5 | 44 | 50 | Stable, heavy floc |
| 8000 | 21.5 | 38 | 44 | Stable, fine floc |

Again the initial viscosities were quite low with the viscosity coefficient being less than 2.5 in each instance, indicating the viscosity is stable.

EXAMPLE IX

In order to show the superior exhaust characteristics of the composition of the present invention, the composition of Example II was compared with two commercially available softener compositions for exhaust characteristics. First a measured amount of each softener which had been previously dispersed in 140°F. water was added to a commercially available automatic washer which has been filled with 9.5 gallons of hot water so as to provide 0.64 gms. of active softener per gallon of hot water. Two towels which had been previously stripped along with a dummy load of 1 bath towel and ½ hand towel were then placed in the water for 1 minute, after which time a conventional anionic type detergent was added and the wash cycle was completed. Subsequent to drying in an automatic dryer, the stripped towels were analyzed by chloroform extraction to determine the amount of softener deposited on the towels.

Table 3

| Softener | Gms. Extracted |
|---|---|
| Commercial Softener A | 0.32 |
| Commercial Softener B | 0.29 |
| Composition of Example II | 0.45 |

As is clearly evident from Table 3, the softener composition of the present invention not only is more stable and less viscious but also exhausts faster by almost 50% when compared to similar commercially available softeners.

EXAMPLE X

Using the formulation of Example II, the softener was heated to the temperature shown in Table 4 and the dye was added with agitation. The softener-dye mixture was then added to the water which had been previously heated to the temperature indicated in Table 4. This mixture is then pre-mixed to form the proper gel-like emulsion and homogenized at the conditions shown in Table 4. Viscosity measurement was taken initially and after two months.

Table 4

| Water-Softener Temperature °F. | Homogenization Pressure (p.s.i.) | Temp. °F. | Viscosity Initial | 2 Weeks | 2 Months |
|---|---|---|---|---|---|
| 140 | 5000 | 140 | 20 | 22 | 38 |

Table 4-continued

| Water-Softener Temperature °F. | Homogenization Pressure (p.s.i.) | Temp. °F. | Viscosity Initial | 2 Weeks | 2 Months |
|---|---|---|---|---|---|
| 140 | 4000 | 140 | 22 | 29 | 48 |
| 140 | 3000 | 140 | 30 | 33 | 57 |
| 140 | 2000 | 140 | 61 | 77 | 122 |
| 160 | 5000 | 160 | 18 | 20 | 36 |
| 160 | 4000 | 160 | 22 | 26 | 44 |
| 160 | 3000 | 160 | 30 | 36 | 62 |
| 160 | 2000 | 160 | 59 | 70 | 118 |
| 180 | 5000 | 180 | 15 | 18 | 29 |
| 180 | 4000 | 180 | 20 | 22 | 43 |
| 180 | 3000 | 180 | 22 | 25 | 42 |
| 180 | 2000 | 180 | 30 | 39 | 63 |

The initial viscosity in each of the above samples is quite low and is stable over a 2-month period, generally having viscosity coefficients of less than 2.3.

COMPARATIVE EXAMPLE I

In order to demonstrate the unexpected stability and low viscosity imparted to cationic fabric softening agents in an emulsified form by the present process and to demonstrate the superiority in terms of storage stability and viscosity of the present product, a fabric softening composition was prepared containing the ingredients set forth in U.S. Pat. No. 3,681,241 in accordance with the unique procedure of the present invention. The fabric softener contained in the following ingredients in the following weight percentage by weight of total composition:

| | |
|---|---|
| Distearyldimethyl ammonium chloride (100%) | 4.00% |
| Amido-ethyl-imidazolinium methyl sulfate from hardened tallow fatty acids (97–100%) | 4.00% |
| Amido-ethyl-imidazolinium methyl sulfate from natural tallow fatty acids (97–100%) | 2.00% |
| Dicocodimethyl ammonium chloride (97–100%) | 2.00% |
| Alfonic 1418-6 | .50% |
| Citric Acid | .05% |
| Deionized water | 87.45% |

Initially, the deionized water was charged to a beaker and heated to 200°F. The fabric softening ingredients which had been previously stripped of alcohol carrier so as to give a maximum alcohol content of 0.24% in the composition were added to the deionized water with good agitation and constant heat until dissolved. Next, Alfonic surfactant was added to the water with agitation. Next, citric acid was dispersed in a small quantity of water with agitation. Thereafter, the mixture was homogenized at 2500 p.s.i. at 180°F. and thereafter force cooled to 78°F.

Upon addition of the citric acid the solution became a semi-gel. Homogenization did reduce the viscosity of the resulting emulsion, but the viscosity started to increase after one day. The initial viscosity was 61.5 centipoises. After one day the viscosity was 145.0 centipoises. Three days later, stratification was noted. One day therafter, or five days after formulation, the viscosity was 146.5 centipoises. Twelve days after formulation, the viscosity has climbed to 695 centipoises even when the present formualtion process was employed. When the sample was put into a test tube after twelve days, separate strata were seen. In addition, the emulsion was opaque, not translucent.

COMPARATIVE EXAMPLE II

To show the criticality of the homogenization pressure, a composition having 85% deionized water and 15% Varisoft 475 was prepared by pre-mixing as in Example I. This pre-mixed emulsion, however, was homogenized at a pressure of 1500 p.s.i., giving an initial viscosity of 508 cps. which increased in 6 weeks to 760 cps. Although the viscosity coefficient was quite low, the initial viscosity was quite high, thereby rendering the sample unacceptable.

COMPARATIVE EXAMPLE III

The formulation of Example VII was prepared except a small percentage of calcium chloride was added as shown in Table 5 with a corresponding decrease in the amount of water used. The calcium chloride added to the deionized water before the softener was added. The components were agitated at 1800 RPM for 5 minutes and homogenized at 6000 p.s.i. The viscosities and appearance were noted as in Example VII.

Table 5

| % $CaCl_2$ | Viscosity Initial | 2 Weeks | 2 Months | Appearance 1 Month | 2 Months |
|---|---|---|---|---|---|
| 0.04 | 16 | 16 | — | Heavy floc stratification | Heavy precipitate |
| 0.04 | 16 | 16 | — | Body particles, stratification | Body particles |
| 0.02 | 20 | 20 | 20 | Body particles, stratification | Body particles |

Although the viscosity remained quite low and stable as would be expected by the introduction of electrolyte, the dispersion formed was not stable and tended to separate. In contrast to the compositions of the present invention, both have a low and stable viscosity and also a stable appearance, indicating a high degree of dispersion stability.

The foregoing examples are for illustrative purposes only and the invention is not to be limited except as set forth in the following claims.

What we claim is:

1. Process for producing an aqueous, storage stable, fabric-softening dispersion having an initial viscosity under 150 centipoises, which comprises:

a. Pre-mixing a mixture consisting essentially of:

1. 7 to 15 percent by weight of a cationic fabric softening agent selected from a quaternary ammonium compound of the formula:

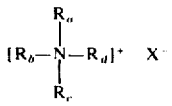

wherein $R_a$ and $R_b$ are alkyl groups having 12 to 22 carbon atoms; $R_c$ and $R_d$ are alkyl groups having from 1 to 6 carbon atoms and $X^-$ is an anion imparting water dispersibility to said compound; and imidazolinium compound having the formula:

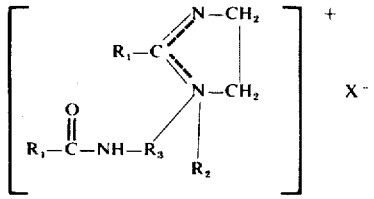

wherein $R_1$ is an aliphatic hydrocarbon radical having from 12 to 22 carbon atoms; $R_2$ is an alkyl group having 1 to 6 carbon atom; $R_3$ is a divalent alkylene group having 1 to 3 carbon atoms and X is an anion imparting water dispersibility to said imidazolinium compound, and mixtures thereof;

2. and from 1 to 10 percent by weight of an aliphatic alcohol selected from the group consisting of methanol, ethanol, propanol, isopropanol, butanol, isobutanol and t-butanol;

with from 74.5–92 percent by weight of an aqueous vehicle substantially free of electrolytes and consisting essentially of water, at a temperature from 65°F. to a temperature above the softening point of said fabric softening agent, with sufficient agitation to provide a creamy, gel-like emulsion free of entrapped air;

b. mixing said creamy, gel-like emulsion at high shear pressure from about 500 to 8000 p.s.i. at a temperature above the softening point of said fabric softening agent to provide a thin, substantially translucent, stable dispersion; and c. thereafter immediately cooling said stable dispersion to a temperature less than 80°F to prevent agglomeration of said dispersed particles and to insure a stable dispersion.

2. Process for producing an aqueous, storage stable, fabric softening dispersion having an initial viscosity under 100 centipoises, which comprises:

a. Pre-mixing a mixture consisting essentially of:

1. from 8–15 percent by weight of a softening agent consisting of an imidazolinium compound having the formula:

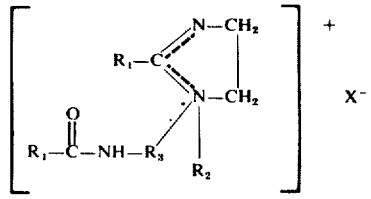

wherein $R_1$ is an aliphatic hydrocarbon radical having from 12 to 22 carbon atoms; $R_2$ is an alkyl group having 1 to 6 carbon atoms; $R_3$ is a divalent alkylene group having 1 to 3 carbon atoms and X is an anion imparting water dispersibility to said compound.

2. and from 1 to 5 percent by weight of an aliphatic alcohol selected from the group consisting of methanol, ethanol, propanol, isopropanol, butanol isobutanol and t-butanol with from 74.5 to 90 percent by weight of an aqueous vehicle substantially free of electrolytes and consisting essentially of water at a temperature from about 65°F. to above the softening temperature of said imidazolinium compound for from 1 to 10 minutes with sufficient agitation to provide a creamy, gel-like emulsion free of entrapped air;

b. homogenizing said creamy, gel-like emulsion at a pressure from about 2000 to 8000 p.s.i. at a temperature between about 65° to 180°F. to provide a thin, substantially translucent stable dispersion; and c. then immediately cooling said stable dispersion to provide a stable aqueous dispersion and to prevent agglomeration of said dispersed particles.

3. The process of claim 2 wherein $R_1$ is an aliphatic hydrocarbon having 16–18 carbon atoms, $R_2$ is methyl and $R_3$ is ethylene.

4. The process of claim 3 wherein said pre-mixing and said homogenizing steps are conducted at the same temperature.

5. The process of claim 3 wherein the water temperature is above the softening point of the softening agent and the softening agent is initially at a temperature above the softening point of the softening agent.

6. The process of claim 5 wherein said pre-mixing and said homogenizing steps are conducted at the same temperature.

7. The product prepared by the process of claim 1.

* * * * *